US010253770B2

(12) United States Patent
Lundstrom

(10) Patent No.: US 10,253,770 B2
(45) Date of Patent: Apr. 9, 2019

(54) HYDRAULIC PUMP ASSEMBLY FOR A VEHICLE

(71) Applicant: BorgWarner TorqTransfer Systems AB, Landskrona (SE)

(72) Inventor: Bo Lundstrom, Glumslöv (SE)

(73) Assignee: BorgWarner Sweden AB, Landskrona (SE)

( * ) Notice: Subject to any disclaimer, the term of this patent is extended or adjusted under 35 U.S.C. 154(b) by 197 days.

(21) Appl. No.: 15/114,197

(22) PCT Filed: Jan. 31, 2015

(86) PCT No.: PCT/EP2015/052024

§ 371 (c)(1),
(2) Date: Jul. 26, 2016

(87) PCT Pub. No.: WO2015/114124

PCT Pub. Date: Aug. 6, 2015

(65) Prior Publication Data

US 2017/0002806 A1 Jan. 5, 2017

(30) Foreign Application Priority Data

Jan. 31, 2014 (SE) ..... 1450111

(51) Int. Cl.
*F04B 49/035* (2006.01)
*F04B 49/22* (2006.01)
(Continued)

(52) U.S. Cl.
CPC ..... *F04B 49/22* (2013.01); *F03C 1/0678* (2013.01); *F04B 1/122* (2013.01); *F04B 1/182* (2013.01); *F04B 1/34* (2013.01); *F04B 17/03* (2013.01); *F15B 11/08* (2013.01); *F15B 13/027* (2013.01); *F15B 2211/20515* (2013.01); *F15B 2211/20561* (2013.01)

(58) Field of Classification Search
CPC ..... F04B 49/035
See application file for complete search history.

(56) References Cited

U.S. PATENT DOCUMENTS 5,791,128 A 8/1998 Rogalsky
2012/0244023 A1 9/2012 Nilsson et al.

FOREIGN PATENT DOCUMENTS

CN 101865190 A 10/2010
CN 103443489 A 12/2013
(Continued)

OTHER PUBLICATIONS

Translation of First Office Action dated Jan. 4, 2018 for CN Application No. 201580006672.6, Applicant: BorgWarner TorqTransfer Systems AB; 9 pages.

*Primary Examiner* — F Daniel Lopez
(74) *Attorney, Agent, or Firm* — BrooksGroup

(57) ABSTRACT

A hydraulic pump assembly for a vehicle is provided, comprising an electrical motor, a hydraulic pump driven by the electrical motor, and a centrifugal regulator connected with a pressure overflow valve connected to the oil outlet of the hydraulic pump, characterized in that the pump assembly further comprises at least two input check valves and at least two output check valves arranged such that a first pressure outlet port is formed when the motor is rotating in a first direction, and a second pressure outlet port is formed when the motor is rotating in an opposite direction.

6 Claims, 3 Drawing Sheets

(51) Int. Cl.

| | |
|---|---|
| ***F04B 1/12*** | (2006.01) |
| ***F04B 1/18*** | (2006.01) |
| ***F04B 1/34*** | (2006.01) |
| ***F03C 1/40*** | (2006.01) |
| ***F04B 17/03*** | (2006.01) |
| ***F15B 11/08*** | (2006.01) |
| ***F15B 13/02*** | (2006.01) |

(56) References Cited

FOREIGN PATENT DOCUMENTS

| | | | |
|---|---|---|---|
| JP | H05104974 | A | 4/1993 |
| JP | 2010158975 | A | 7/2010 |

HYDRAULIC PUMP ASSEMBLY FOR A VEHICLE

This application claims the benefit of Swedish Application No. 1450111-8 filed Jan. 31, 2014 and PCT Application No. EP2015/052024 filed Jan. 31, 2015.

TECHNICAL FIELD

The present invention relates to a hydraulic actuator for a vehicle. More particularly, the present invention relates to a reversible hydraulic pump assembly for torque control in hydraulic vehicle systems.

BACKGROUND

Hydraulic actuators are normally used in vehicles for actuating various types of systems, such as AWD couplings and gear shifts.

In EP2310709 an electrical axial piston pump is described, having a centrifugal valve device that allows it to control the pressure output. This device can control one system, for example an AWD coupling, with lower hysteresis than if the same coupling should be controlled with proportional solenoid valves. Further, the centrifugal valve device does not require a micro filter. For applications involving two couplings or one coupling and one gear shift the described axial piston pump must be provided with additional electrical shift valves.

In order to reduce complexity, weight and costs it would be desired to provide an improved hydraulic pump assembly for use in vehicle applications, and preferably such applications having two couplings or one coupling and one gear shift.

SUMMARY

An object of the present invention is to provide a hydraulic pump assembly in combination with a bidirectional control.

According to various aspects of the present invention, a hydraulic pump assembly is provided in accordance with the features set forth in the independent claim. Preferred embodiments are defined by the appended dependent claims.

BRIEF DESCRIPTION OF DRAWINGS

Embodiments of the invention will be described in the following; reference being made it the appended drawings which illustrate non-limiting examples of how the inventive concept can be reduced into practice.

DETAILED DESCRIPTION

Figure 1:
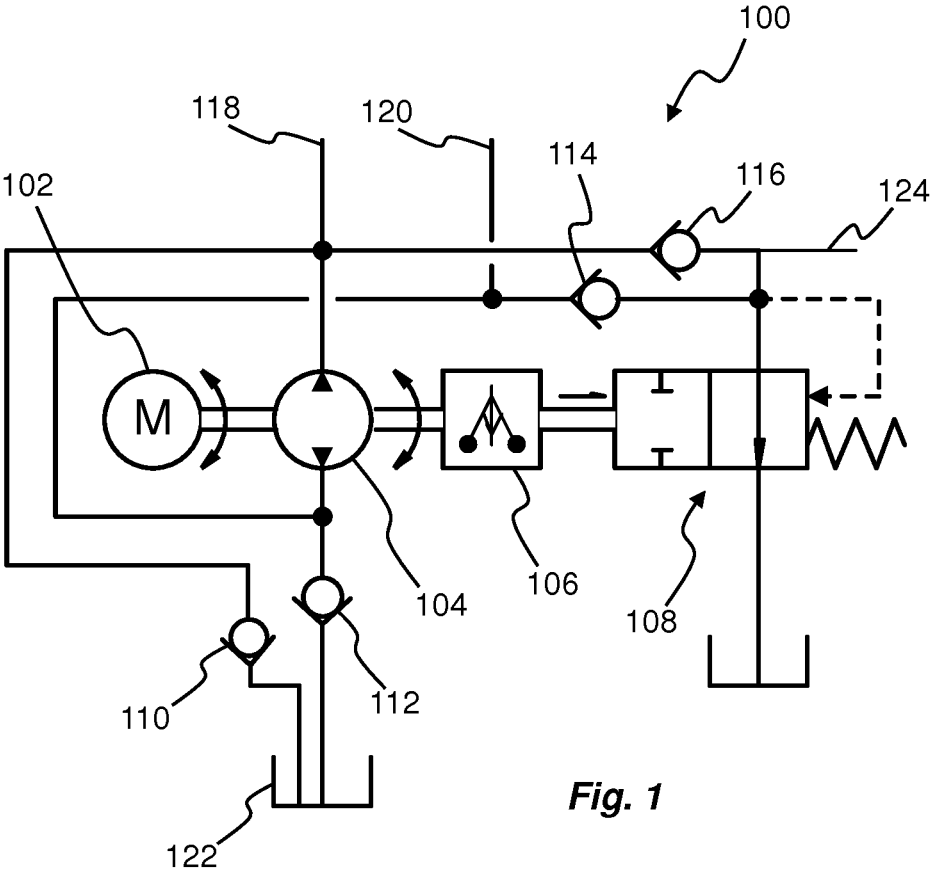
FIG. 1 shows a hydraulic scheme for a pump assembly according to an embodiment.

FIG. 1 shows a hydraulic scheme for a pump assembly 100 which may be applicable for various hydraulic actuators in a vehicle. The pump assembly 100 comprises a motor 102 and a hydraulic pump 104, as well as a centrifugal regulator 106 in connection with a pressure overflow valve 108. The pump assembly 100 may e.g. be based on the same principle as described in EP2310709 or in EP2486279, both by the same applicant as the present application. The pump assembly 100 is preferably provided with bidirectional control whereby a simple and safe solution is achieved by using positive or negative voltage.

By adding two input check valves 110, 112 and two output check valves 114, 116 the direction of the flow is dependant on the motor direction of rotation. As can be seen in FIG. 1, a first port 118 may be connected to a first actuator (not shown), such as a hydraulically operated coupling or a hydraulically operated gear shift, and a second port 120 may be connected to a second actuator (not shown), such as a hydraulically operated coupling or a hydraulically operated gear shift.

When the motor 102 is rotating in a first direction, hydraulic fluid will be drawn from the reservoir 122 via the first input check valve 110, through the pump 104, to the second port 120. The first output check valve 114 is in fluid connection with the overflow valve 108.

When the motor 102 is rotating in the opposite direction, hydraulic fluid will be drawn from the reservoir 122 via the second input check valve 112, through the pump 104, to the first port 118. The second output check valve 116 is in fluid connection with the overflow valve 108.

A third port 124 may also be provided. The third port 124 could be used in combination with one of the first port 118 or second port 120 or together with both the first and second ports 118, 120. Pressure from the third port 124 will be independent of direction of rotation of the motor 102.

Figure 2:
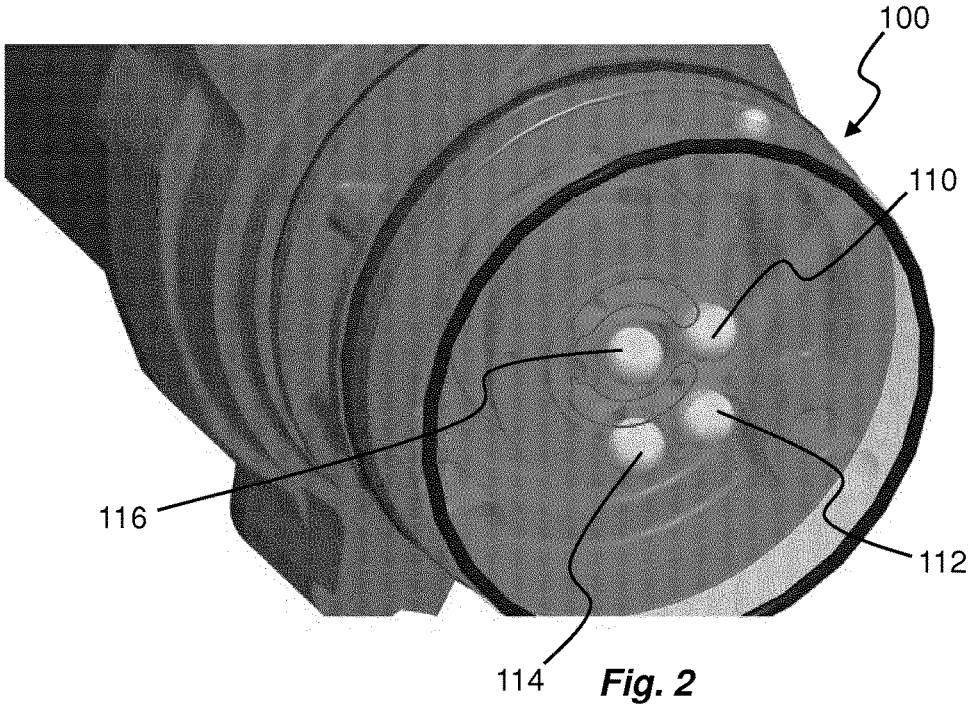
FIGS. 2 and 3 illustrate a hydraulic pump assembly according to an embodiment.
Figure 3:
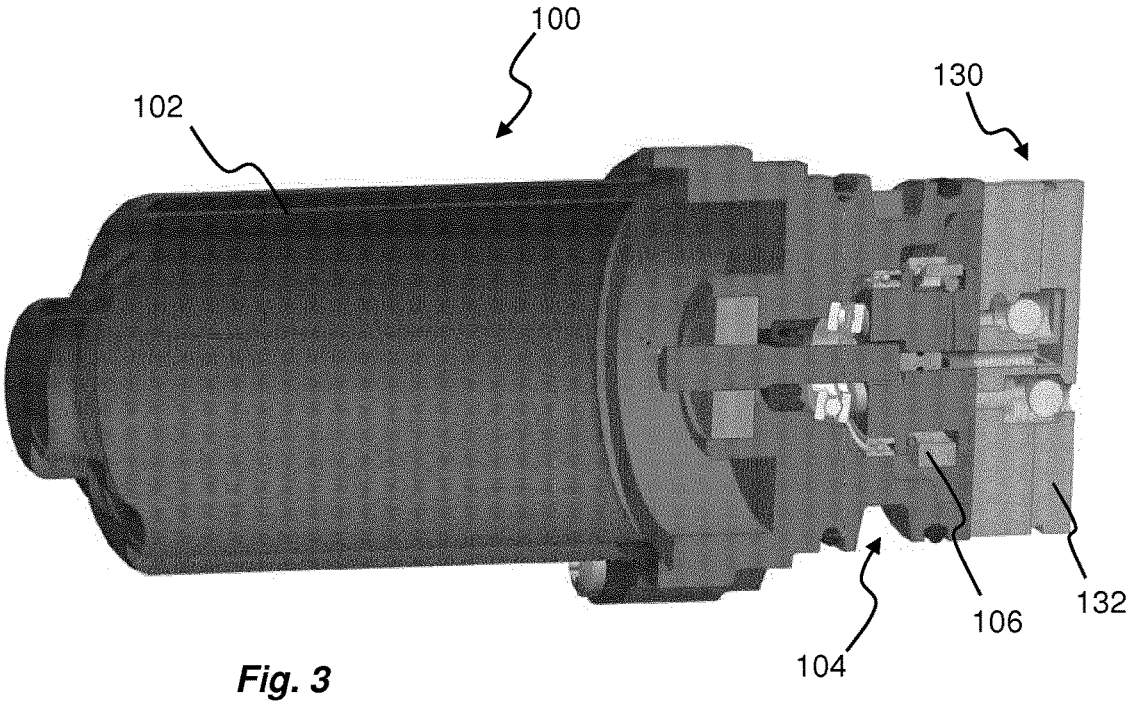

Now turning to FIGS. 2 and 3 an embodiment of a pump assembly 100 is shown in more details. The pump assembly comprises a motor 102 and a hydraulic pump 104, as well as a centrifugal regulator 106 in connection with a pressure overflow valve 108. The pump assembly 100 may e.g. be based on the same principle as described in EP2310709 or in EP2486279, both by the same applicant as the present application. However, a pump lid 130 is provided with an extra pump plate 132 accommodating the input and output check valves 110, 112, 114, 116.

Action is preferably also taken to make the first and second ports 118, 120 more symmetrical in a washer plate of the pump assembly 100.

An alternative use could be to use the third port 124 in combination with one of the first or second port 118, 120, or together with both the first and second port 118, 120. Pressure from the third port 124 will be independent of direction of rotation.

Figure 4:
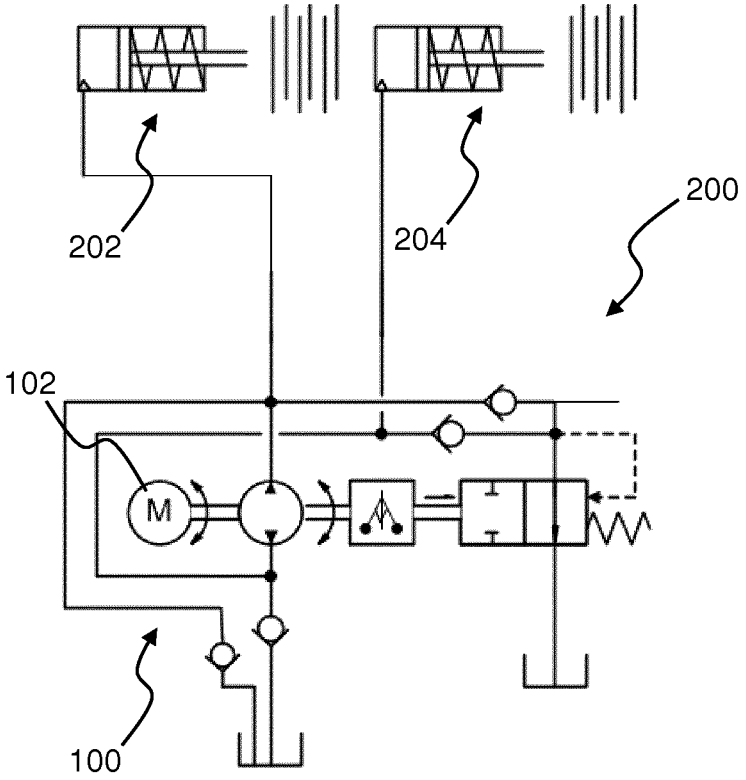
FIGS. 4 and 5 show hydraulic schemes for two different hydraulic actuators according to different embodiments.

FIG. 4 shows an embodiment of a hydraulic actuator 200 comprising two hydraulically actuated clutches or couplings 202, 204. The couplings 202, 204 are actuated by means of reversible pump assembly 100 being identical to what has been described with reference to FIG. 1. Hence, the first coupling 202 will be actuated when the motor 102 is driven in a first direction, while the second coupling 204 will be actuated when the motor 102 is driven in the opposite direction.

Figure 5:
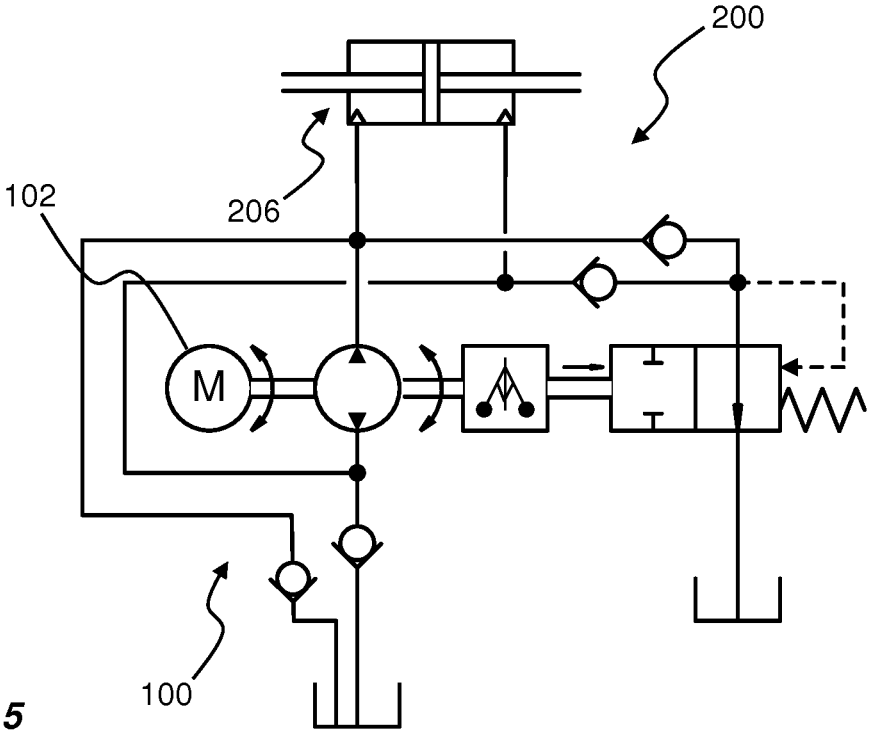

FIG. 5 shows an embodiment of a hydraulic actuator 200 comprising one hydraulically actuated piston 206. The piston 206 may e.g. be a shifting piston for changing between low range gear and high range gear in a transfer case, while an additional coupling (not shown) may be provided to change between two wheel drive mode and four wheel drive mode. The pump assembly 100 for actuating the piston 206 is based on the pump assembly of EP2486279 but includes the check valves 110, 112, 114, 116 for providing the reversibility in accordance with the description of FIG. 1. The first and the second ports 118, 120 are connected to opposite sides of the piston 206 whereby it is possible to control the direction of movement of the piston 206 by controlling the rotational direction of the motor 102 of the pump assembly 100.

It will be appreciated that the embodiments described in the foregoing may be combined without departing from the scope as defined by the appended patent claims.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

What is claimed is:

1. A hydraulic actuator comprising:

a hydraulic pump assembly comprising an electrical motor, a hydraulic pump driven by the electrical motor, and a centrifugal regulator in connection with a pressure overflow valve connected to a first oil port and a second oil port of the hydraulic pump, wherein the pump assembly further comprises a first input check valve and a second input check valve, and a first output check valve and a second output check valve arranged such that when the motor is rotating in a first direction fluid is drawn to the first oil port, and when the motor is rotating in an opposite direction fluid is drawn to the second oil port; and a first coupling connected to the first oil port, and a second coupling connected to the second oil port.

2. The hydraulic actuator according to claim 1, wherein the first output check valve is arranged between the first oil port and the pressure overflow valve and the second output check valve is arranged between the second oil port and the pressure overflow valve.

3. The hydraulic actuator according to claim 1, wherein the first input check valve is connected to the first oil port, and wherein the second input check valve is connected to the second oil port.

4. A hydraulic actuator comprising:

a hydraulic pump assembly comprising an electrical motor, a hydraulic pump driven by the electrical motor, and a centrifugal regulator in connection with a pressure overflow valve connected to a first oil port and a second oil port of the hydraulic pump, wherein the pump assembly further comprises a first input check valve and a second input check valve, and a first output check valve and a second output check valve arranged such that when the motor is rotating in a first direction fluid is drawn to the first oil port, and when the motor is rotating in an opposite direction fluid is drawn to the second oil port; and a piston, wherein a first side of the piston is connected to the first oil port, and a second side of the piston is connected to the second oil port.

5. The hydraulic actuator according to claim 4, wherein the first output check valve is arranged between the first oil port and the pressure overflow valve and the second output check valve is arranged between the second oil port and the pressure overflow valve.

6. The hydraulic actuator according to claim 4, wherein the first input check valve is connected to the first oil port, and wherein the second input check valve is connected to the second oil port.

* * * * *